US007290671B2

(12) United States Patent
Kimura et al.

(10) Patent No.: US 7,290,671 B2
(45) Date of Patent: Nov. 6, 2007

(54) CRANE

(75) Inventors: Hiroshi Kimura, Akashi (JP); Keisuke Fukumoto, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 0 days.

(21) Appl. No.: 11/193,478

(22) Filed: Aug. 1, 2005

(65) Prior Publication Data

US 2006/0037926 A1 Feb. 23, 2006

(30) Foreign Application Priority Data

Aug. 23, 2004 (JP) ..... 2004-242392

(51) Int. Cl.
*B66C 23/34* (2006.01)

(52) U.S. Cl. ..... 212/175; 212/177

(58) Field of Classification Search ..... 212/175, 212/177, 239, 240, 232
See application file for complete search history.

(56) References Cited

U.S. PATENT DOCUMENTS

| | | | | |
|---|---|---|---|---|
| 3,792,781 | A * | 2/1974 | Blase et al. | 212/178 |
| 4,081,081 | A * | 3/1978 | Morrow et al. | 212/178 |
| 4,579,234 | A * | 4/1986 | Delago et al. | 212/178 |
| 5,222,613 | A * | 6/1993 | McGhie | 212/195 |
| 5,484,069 | A * | 1/1996 | Lanning | 212/270 |
| 5,649,635 | A * | 7/1997 | Casavant et al. | 212/177 |
| 5,960,970 | A | 10/1999 | Walker | |
| 6,131,751 | A * | 10/2000 | Pech et al. | 212/178 |
| 6,481,202 | B1 | 11/2002 | Zuehlke et al. | |
| 2005/0098522 | A1 | 5/2005 | Mizuta et al. | |
| 2005/0098523 | A1 | 5/2005 | Mizuta et al. | |

FOREIGN PATENT DOCUMENTS

| | | | |
|---|---|---|---|
| JP | 6-16388 | * | 1/1994 |
| JP | 8-12266 | | 1/1996 |
| JP | 2542385 | | 4/1997 |

OTHER PUBLICATIONS

Patent Abstracts of Japan, JP 10-139375, May 26, 1998.

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

A crane performs a self-assembling/disassembling operation using a hoisting winch, a hoisting rope, and a hanging hook, and includes a sheave device for guiding the hoisting rope on an upper portion of a lower boom. The sheave device includes a first sheave on a rear side of the lower boom and second and third sheaves on a front side of the lower boom. The second and third sheaves are arranged next to each other in the left-right direction, and the rope end is attached to the lower boom at a position near the top end of the lower boom. Accordingly, a lifting height in the self-assembling/disassembling operation is increased and the rope end can be attached/detached easily and safely from the front side of the lower boom when the lower boom is laid on the ground.

2 Claims, 6 Drawing Sheets

CRANE

BACKGROUND OF THE INVENTION

1. Field of the Invention

The present invention relates to a crane including a boom provided with a device for attaching/detaching crawlers and the like by itself.

2. Description of the Related Art

In general, large crawler cranes are difficult to transport the entire body thereof together, and are therefore divided into a plurality of blocks to be transported individually by trailers. Then, the blocks are assembled together at the scene. In the assembling/disassembling process, if an additional crane is not available, components are assembled/disassembled using their own equipment.

In FIGS. 5 and 6, a hoisting rope 9 pulled out from a hoisting winch 8 extends along a path through a first sheave 5, a second sheave 6, a hook sheave 11 of a hanging hook 10, and a third sheave 7, in that order. A rope end 9*a* of the hoisting rope 9 is attached to a bracket 12 provided on a lower boom 4 at a position under the first sheave 5.

A crawler 2 placed on a trailer (not shown) is lifted and moved closer to a lower traveling body 1 by driving the hoisting winch 8 while the crawler 2 is attached to the hanging hook 10 with a hanging rope 14 and raising the lower boom 4. Then, the crawler 2 is assembled to the lower traveling body 1.

In this case, since the second and third sheaves 6 and 7 are arranged vertically on a front side of the lower boom 4, the following problems occur:

(i) Lifting Height

Since the hoisting rope 9 from the first sheave 5 extends along the above-described path, the hanging hook 10 hangs in a longitudinal orientation such that side surfaces in the width direction of the hanging hook 10 face the lower boom 4, as shown in FIG. 5. Therefore, the hook 10 easily approaches and interferes with the lower boom 4. As a result, the hook 10 cannot be lifted high, that is, the lifting height cannot be increased, which is disadvantageous in the self-attaching/detaching operation.

(ii) Attachment/Detachment of Rope End 9*a*

The rope end 9*a* is attached to the bracket 12 at a position below the first sheave 5 (position nearer to the base end of the lower boom 4). Accordingly, the attachment position is shifted from the top end of the lower boom 4 toward the base end thereof (out of reach of a hand from the top end). Therefore, as shown in FIG. 6, a worker W must get inside the narrow lower boom 4 to attach/detach the rope end 9*a* of the hoisting rope 9. The task of attaching/detaching the rope end 9*a* is cumbersome, and there is also a safety hazard. Since the worker W can reach a top end portion of the lower boom 4 from the outside (from the front when the lower boom 4 is laid down as shown in FIG. 6) without getting inside the lower boom 4, the rope end 9*a* may be attached to the top end portion of the lower boom 4. However, in this case, the rope end 9*a* is obstructed by a rope segment between the first and second sheaves 5 and 6, and cannot be attached at a position above this rope segment, that is, a position nearer to the top end of the lower boom 4.

Japanese Unexamined Patent Application Publication No. 6-16388 discloses a structure in which, in comparison with the structure shown in FIG. 6, only the second sheave 6 is provided on the front side of the lower boom 4. In this structure, the hoisting rope 9 extends through the first and second sheaves 5 and 6 and the hook sheave 11, in that order, and the rope end 9*a* is attached to the front side of the lower boom 4 (bottom side in FIG. 6) at a position under the second sheave 6. However, the problems of above items (i) and (ii) cannot be solved by this structure.

SUMMARY OF THE INVENTION

Accordingly, an object of the present invention is to provide a crane which has an increased lifting height in a hanging operation by itself and with which a task of attaching/detaching a rope end can be easily and safely performed from the front when a lower boom is laid on the ground.

The basic structure of a crane according to the present invention will be described below.

According to the present invention, a crane includes a lower traveling body; an upper rotating body mounted on the lower traveling body in such a manner that the upper rotating body can rotate around a rotating axis; a boom unit provided on the upper rotating body and including a lower boom; a hoisting device provided on the upper rotating body, the hoisting device lifting and lowering a hanging hook that hangs from an end of the boom unit; and a sheave device for a self-assembling/disassembling operation provided on an upper section of the lower boom, a hoisting rope from the hoisting device extending through the sheave device. The sheave device includes a first sheave provided on a rear side of the lower boom and being rotatable around a horizontal axis extending in a left-right direction; second and third sheaves provided next to each other in the left-right direction on a front side of the lower boom and being rotatable around a horizontal axis extending in the left-right direction; and a rope-end anchor provided on a top end portion of the lower boom at a position above the first sheave, the rope-end anchor securing a rope end of the hoisting rope extending through the first sheave, the second sheave, a hook sheave of the hanging hook, and the third sheave, in that order.

According to the present invention, the second and third sheaves are arranged next to each other in the left-right direction on the front side of the lower boom. Therefore, the hook sheave of the hanging hook is orientated in the left-right direction, and the hanging hook hangs in a transverse orientation (surfaces of the hanging hook in the thickness direction thereof face the lower boom), and therefore the hanging hook does not easily interferes with the lower boom. As a result, the hanging hook can be lifted high, that is, the lifting height can be increased.

In addition, since the second and third sheaves are arranged next to each other in the left-right direction, the rope from the hook sheave of the hanging hook can be simply guided to the top end portion of the lower boom through the third sheave and be attached to the rope-end anchor.

Accordingly, the task of attaching/detaching the rope end can be performed from the top side of the lower boom (front side when the lower boom is laid on the ground). More specifically, unlike the crane explained in "Description of the Related Art", in which the rope end can only be attached at a position shifted from the top end of the lower boom toward the base end thereof, the worker can easily and safely attach/detach the rope end from the outside without getting inside the lower boom.

DESCRIPTION OF THE PREFERRED EMBODIMENTS

A crawler crane according to an embodiment of the present invention will be described below with reference to the accompanying drawings.

FIGS. 1 to 4 are diagrams showing the manner in which a crawler crane attaches/detaches a crawler by itself.

Figure 1:
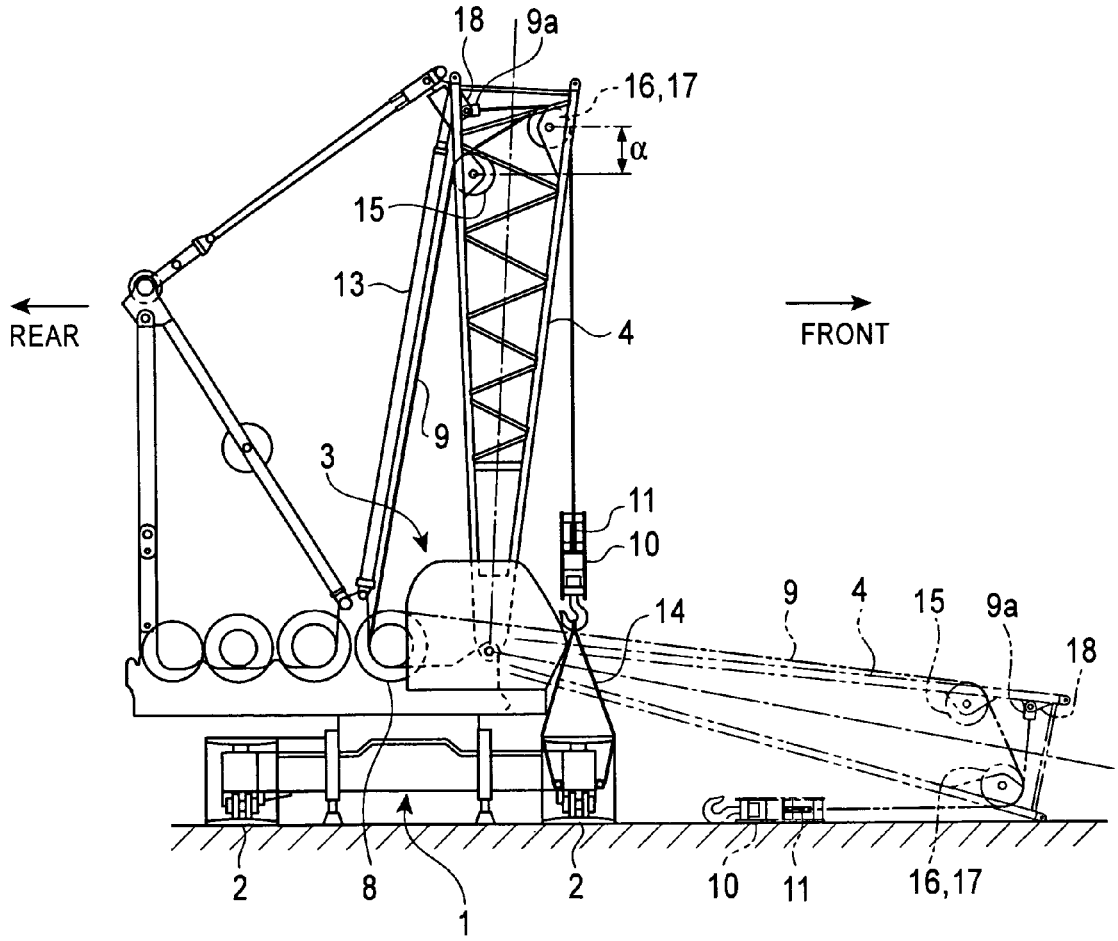
FIG. 1 is a side view showing the manner in which a crane according to an embodiment of the present invention performs an operation of attaching/detaching a crawler by itself.

With reference to FIG. 1, a crawler crane includes a lower traveling body 1 having crawlers 2 at both ends thereof and an upper rotating body 3 mounted on the lower traveling body 1 in such a manner that the upper rotating body 3 can rotate around a rotating axis (vertical axis). A boom unit is attached to the upper rotating body 3 in such a manner that the boom unit can be raised upward. The boom unit includes a lower boom (also called a base boom) 4 at the bottom, and only the lower boom 4 is shown in FIG. 1. A sheave device for a self-assembling/disassembling operation is provided on an upper section of the lower boom 4. The sheave device includes a first sheave 15 provided on a rear side of the lower boom 4 at the center in the left-right direction and second and third sheaves 16 and 17 provided on a front side of the lower boom 4, each sheave being rotatable around a horizontal axis extending in the left-right direction. The left and right sides in FIG. 1 corresponds to the rear and front sides, respectively.

The second and third sheaves 16 and 17 are positioned at the same height, as shown in FIG. 1. The self-attaching/detaching operation of the crawler 2 is performed using the three sheaves 15 to 17 and a hoisting device provided on the upper rotating body 3.

Figure 2:
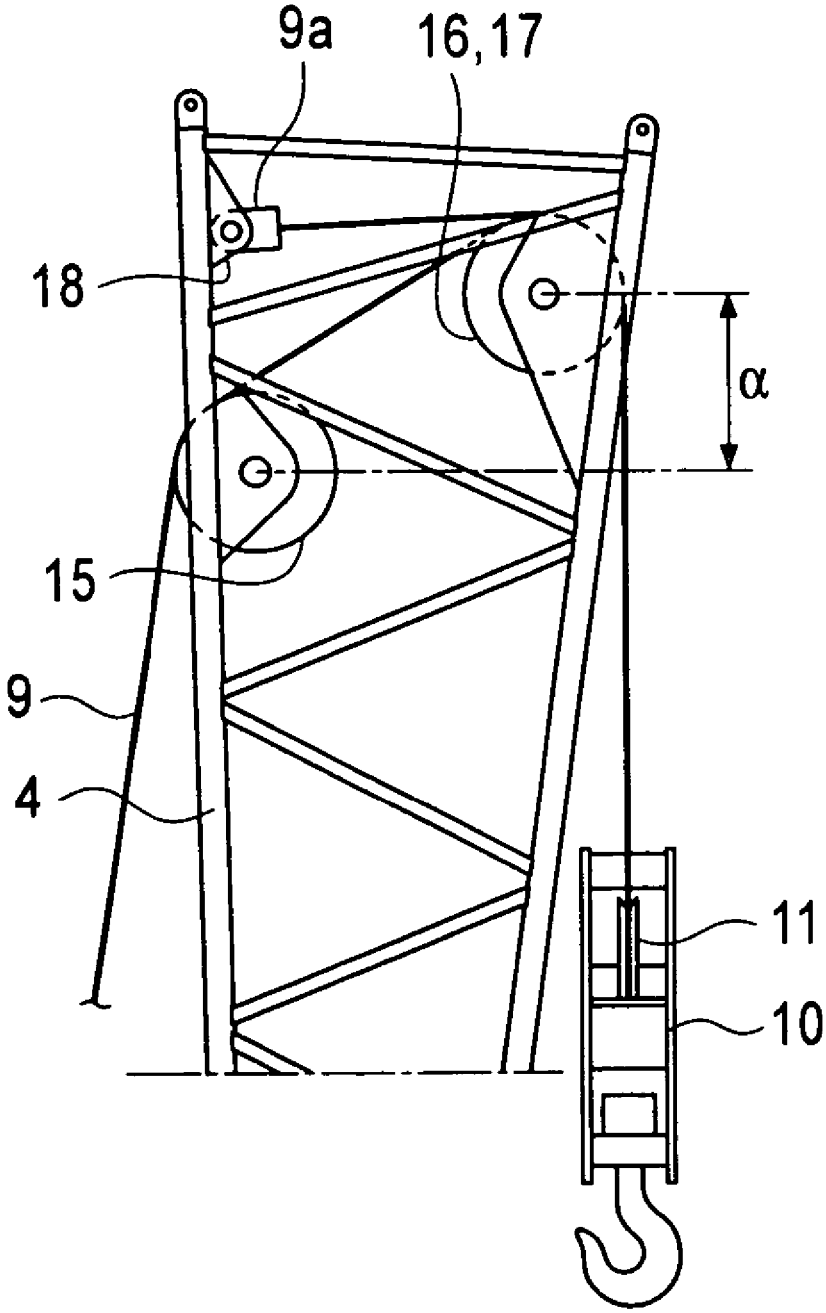
FIG. 2 is an enlarged view of an upper section of a lower boom included in the crane.
Figure 4:
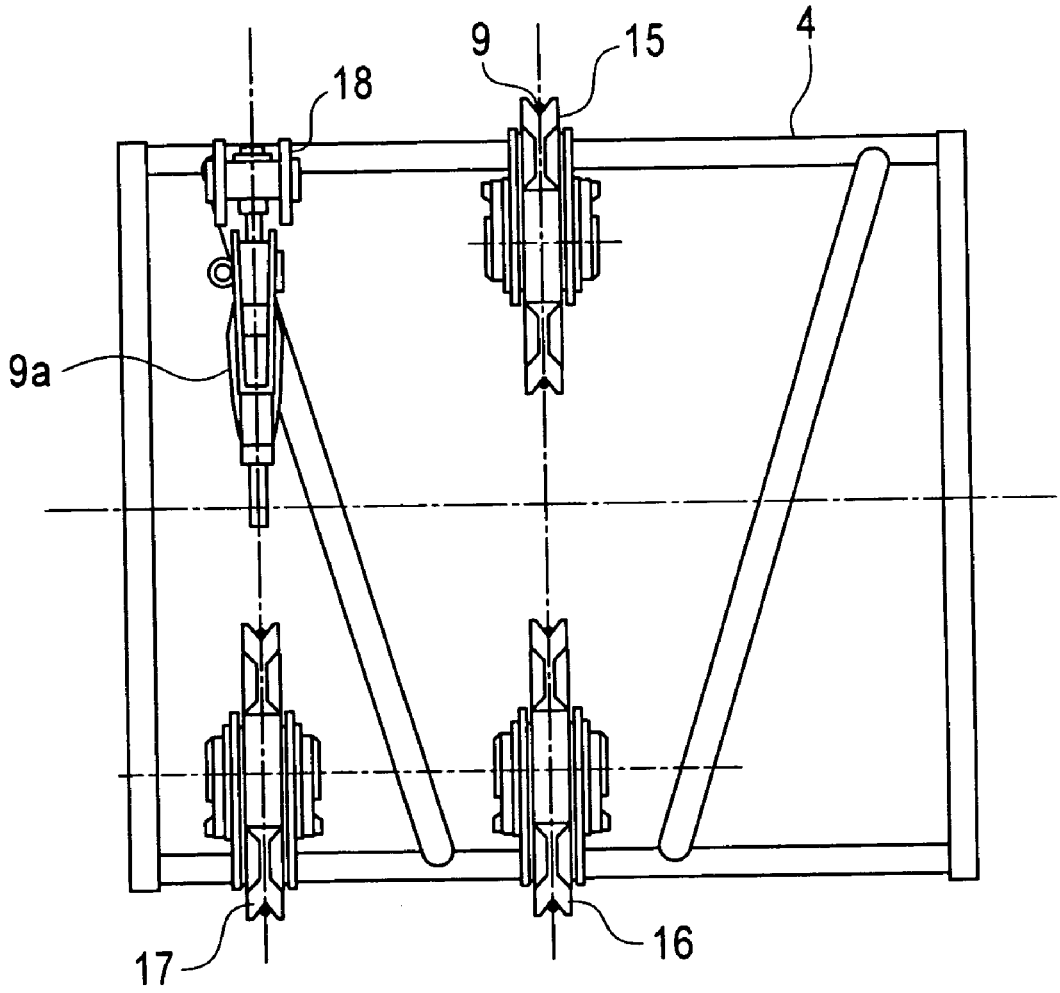
FIG. 4 is an enlarged view of the lower boom in the state shown in FIG. 3, which is seen from the front.
Figure 5:
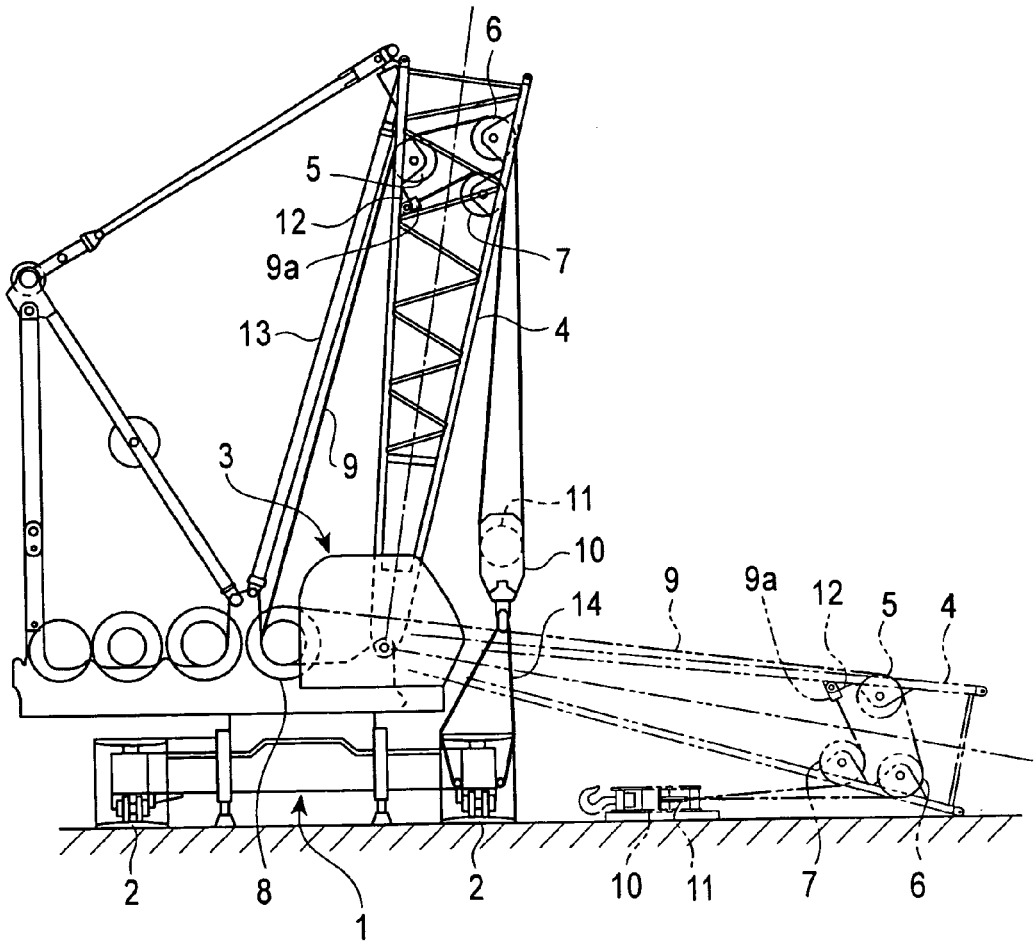
FIG. 5 is a side view showing the manner in which a known crane performs an operation of attaching/detaching a crawler by itself.

As shown in FIG. 4, the second and third sheaves 16 and 17 are arranged next to each other on the same axis in the left-right direction at a position above the first sheave 15 (nearer to the top end of the lower boom 4). In FIGS. 1 and 2, $\alpha$ shows a displacement of the second and third sheaves 16 and 17 from the first sheave 15.

The second sheave 16 is aligned with the first sheave 15 along the center line in the left-right direction when seen from the front side of the lower boom 4, and the hoisting rope 9 linearly stretches between the first sheave 15 and the second sheave 16.

In addition, a bracket 18, which functions as a rope-end anchor, is provided on the rear side of a top end portion of the lower boom 4 at a position above the sheaves 15 to 17 and near a connecting portion between the lower boom 4 and a middle boom (not shown).

In this structure, when the crane assembles the crawler 2 to the lower traveling body 1 by itself, the following process is performed. That is, as shown in FIGS. 1 and 2, the hoisting rope 9 pulled out from the hoisting winch 8 is stretched along a path through the first sheave 15, the second sheave 16, a hook sheave 11 of a hanging hook 10, and the third sheave 17, in that order, and the rope end 9*a* is attached to the bracket 18.

Figure 3:
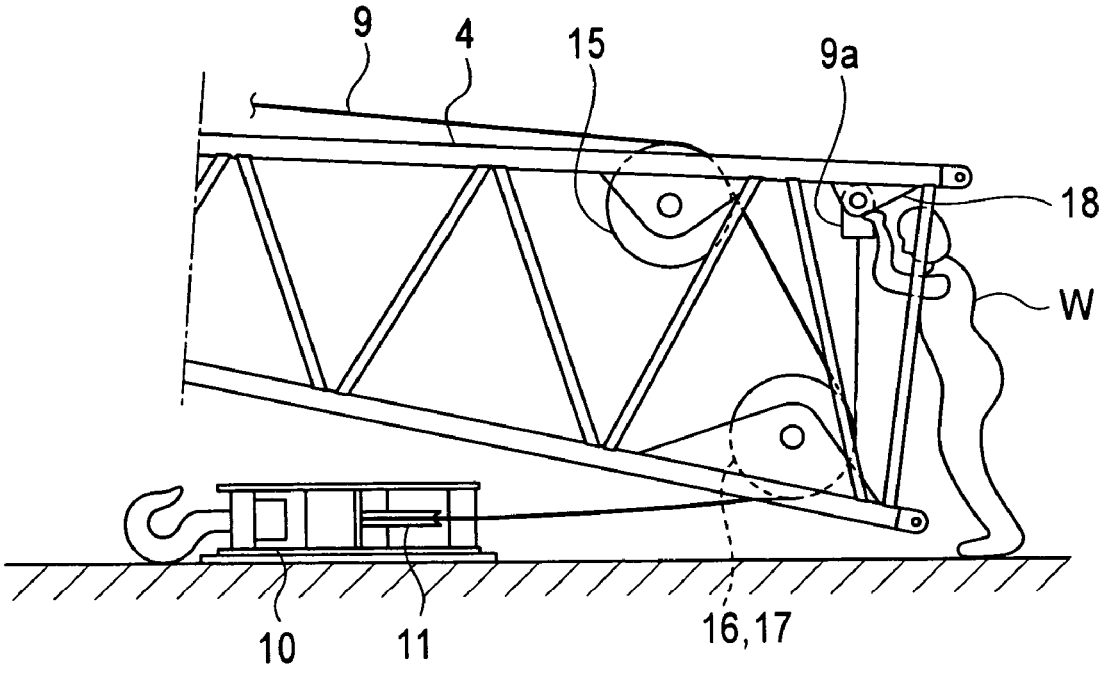
FIG. 3 a diagram corresponding to FIG. 2 showing the state in which the boom is laid on the ground.

In this case, the attachment position of the rope end 9*a* is on the top end portion of the lower boom 4, that is, near the front side of the lower boom 4 when the lower boom 4 is laid on the ground, as shown in FIG. 1 by the two-dot chain lines and in FIG. 3. Therefore, as shown in FIG. 3, the worker W can put his or her hand into the lower boom 4 on the ground from the front side and attach the rope end 9*a*.

Figure 6:
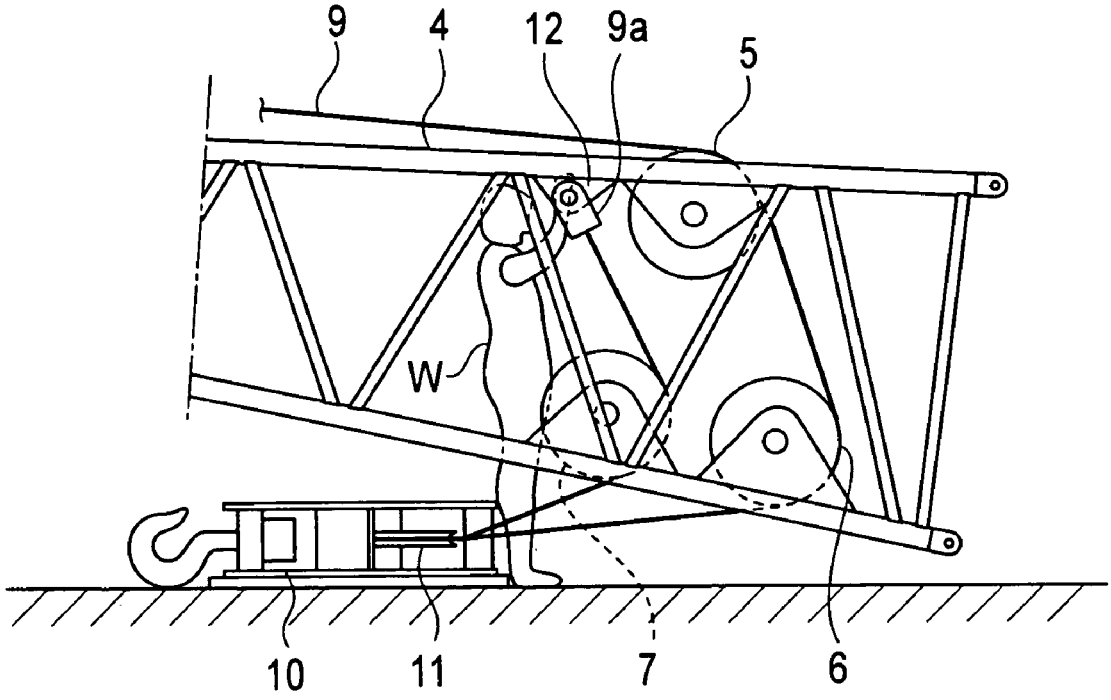
FIG. 6 is a side view showing the state in which a lower boom of the known crane is laid on the ground.

Therefore, unlike the crane explained in "Description of the Related Art" (see FIG. 6), in which the rope end 9*a* can only be attached at a position shifted from the top end of the lower boom 4 toward the base end thereof, it is not necessary for the worker W to get inside the lower boom 4. Therefore, the rope end 9*a* can be attached easily and safely.

The second and third sheaves 16 and 17 are arranged next to each other in the left-right direction on the front side of the lower boom 4. Therefore, as shown in FIGS. 1 and 2, the hook sheave 11 of the hanging hook 10 is orientated in the left-right direction. Thus, the hanging hook 10 hangs in a transverse orientation (surfaces of the hanging hook 10 in the thickness direction thereof face the front side of the lower boom 4), and therefore the hanging hook 10 does not easily interferes with the front side of the lower boom 4. As a result, the hanging hook 10 can be lifted high, that is, the lifting height can be increased.

The crawler 2 placed on a trailer (not shown) is lifted and moved closer to the lower traveling body 1 by driving the hoisting winch 8 while the crawler 2 is attached to the hanging hook 10 with a hanging rope 14 and raising the lower boom 4. Then, the crawler 2 is attached to the lower traveling body 1.

When the crane is disassembled, the crawler 2 is detached from the lower traveling body 1 by following the above-described procedure in reverse.

After the crawler 2 is attached or detached, the rope end 9*a* is released from the bracket 18 while the lower boom 4 is laid on the ground. Similar to the task of attaching the rope end 9*a*, the task of releasing it can also be performed easily and safely from the front side of the lower boom 4.

Other Embodiments (1) Although the first to third sheaves 15 to 17 are arranged such that almost the entire bodies thereof are positioned inside the lower boom 4 in cross section, as shown in FIGS. 1 to 4. However, when the sheaves 15 to 17 do not interfere with other components, they may also be arranged so as to partially protrude from the lower boom 4.

(2) The second and third sheaves 16 and 17 are normally positioned nearer to the top end of the lower boom 4 than the first sheave 15. However, the second and third sheaves 16 and 17 may also be provided at substantially the same position as the first sheave 15 in the vertical direction.

(3) The second and third sheaves 16 and 17 are not necessarily arranged on the same axis in the left-right direction as in the above-described embodiment, and may also be vertically shifted from each other.

(4) The attachment position of the rope end 9*a* (position of the bracket 18) is preferably as near the top end of the lower boom 4 as possible. However, as long as the worker's hand can reach from the top side of the lower boom 4, the attachment position may also be below the second and third sheaves 16 and 17 and above the first sheave 15.

(5) The present invention is particularly suitable for application to a crawler crane as in the above-described embodiment. However, the present invention may also be applied to wheel cranes as long as they include a collapsible boom unit and perform a hoisting process for assembling/disassembling by itself.

Although the invention has been described with reference to the preferred embodiments in the attached figures, it is noted that equivalents may be employed and substitutions made herein without departing from the scope of the invention as recited in the claims.

What is claimed is:

1. A crane comprising:

a lower traveling body;

an upper rotating body mounted on the lower traveling body in such a manner that the upper rotating body can rotate around a rotating axis;

a boom unit provided on the upper rotating body and including a lower boom having a lower end pivoted to the upper rotating body and continuously tapering outward from said lower end of the lower boom to an upper end of the lower boom;

a hoisting device provided on the upper rotating body, the hoisting device lifting and lowering a hanging hook that hangs from the boom unit; and a sheave device for self-assembling/disassembling provided on an upper section of the lower boom, a hoisting rope from the hoisting device extending through the sheave device, the sheave device comprising:

a first sheave provided on a rear side of the lower boom and being rotatable around a horizontal axis extending in a left-right direction;

second and third sheaves provided next to each other in the left-right direction on a front side of the lower boom and being rotatable around a horizontal axis extending in the left-right direction; and a rope-end anchor provided adjacent the rear side of the upper end of the lower boom at a position above the first sheave, the rope-end anchor securing a rope end of the hoisting rope extending, from the hoisting device, through the first sheave, the second sheave, a hook sheave of the hanging hook, and the third sheave, in that order.

2. The crane according to claim 1, wherein the second and third sheaves are positioned above the first sheave.

* * * * *